US007615698B2

(12) United States Patent
Woodhouse

(10) Patent No.: US 7,615,698 B2
(45) Date of Patent: Nov. 10, 2009

(54) VIBARATO TRAINER

(76) Inventor: James Harvey Woodhouse, 2325 Cottage Dr., Stillwater, MN (US) 55082

( * ) Notice: Subject to any disclaimer, the term of this patent is extended or adjusted under 35 U.S.C. 154(b) by 87 days.

(21) Appl. No.: 12/012,148

(22) Filed: Jan. 31, 2008

(65) Prior Publication Data

US 2008/0190262 A1 Aug. 14, 2008

Related U.S. Application Data

(60) Provisional application No. 60/898,825, filed on Feb. 2, 2007.

(51) Int. Cl.
*G10D 1/02* (2006.01)

(52) U.S. Cl. ..... 84/281

(58) Field of Classification Search ..... 84/280, 84/281, 274

See application file for complete search history.

(56) References Cited

U.S. PATENT DOCUMENTS 3,619,470 A * 11/1971 Harris ..... 84/281

* cited by examiner

*Primary Examiner*—Kimberly R Lockett
(74) *Attorney, Agent, or Firm*—Roger Belfay

(57) ABSTRACT

The Vibrato trainer comprises: a stem; an attachment assembly for securing said stem to a tuning peg of a musical instrument; and a base; a plurality of pads attached to said base to assure stable placement of said base against said musical instrument; one or more elastic bands attached to said base for securing said base to said musical instrument; and one or more guide posts for guiding the hand and wrist, said guide posts removably attached to said stem.

In use the attachment means is attached to the tuning peg of a stringed instrument and the base is placed against the back of the instrument so that the stem is parallel and beneath the finger board of the instrument. So that guideposts contact the wrist to provide a physical reminder that the trainee's wrist is out of position.

19 Claims, 6 Drawing Sheets

VIBARATO TRAINER

CROSS REFERENCE TO RELATED APPLICATIONS

The application listed below is the only application related to this application. This application claims benefit of the earlier filing date under 35 USC 119(e) of provisional application No. 60/898,825 filed on Feb. 2, 2007.

The Vibrato trainer comprises: a stem; an attachment assembly for securing said stem to a tuning peg of a musical instrument; and a base; a plurality of pads attached to said base to assure stable placement of said base against said musical instrument; one or more elastic bands attached to said base for securing said base to said musical instrument; and one or more guide posts for guiding the hand and wrist, said guide posts removably attached to said stem.

STATEMENT REGARDING FEDERAL SPONSORSHIP

No invention claimed in this application was made under Federally sponsored research or development.

BACKGROUND OF INVENTION

This invention relates to the teaching and musical arts. Specifically the present invention is a training device for students of stringed instruments. Improper positioning of the wrist while performing Vibrato musical passages is a common problem with such students. Unfortunately the problem is one which does not easily manifest itself to the student until the later stages of training. The longer defective wrist positioning is permitted to persist the harder it is to extinguish. In the later stages of training, faulty wrist positioning impedes, or in some cases makes impossible, certain techniques which must be mastered to achieve higher levels of virtuosity. The advantage of the present invention is that it provides immediate feedback to the student as soon any vibrato techniques are attempted with improper wrist positioning. Provision of this feedback early in a student's education prevents extensive unlearning of wrist position which occurs in some students.

BRIEF SUMMARY OF THE INVENTION

The Vibrato trainer comprises: a stem, said stem having a first end and a second end; an attachment assembly for securing said stem to a tuning peg of a musical instrument and attached to said first end of said stem; and a base attached to said second end of said stem; a plurality of pads attached to said base to assure stable placement of said base against said musical instrument; one or more elastic bands attached to said base for securing said base to said musical instrument; and one or more guide posts for guiding the hand and wrist, said guide posts removably attached to said stem.

DETAILED DESCRIPTION

Figure 1:
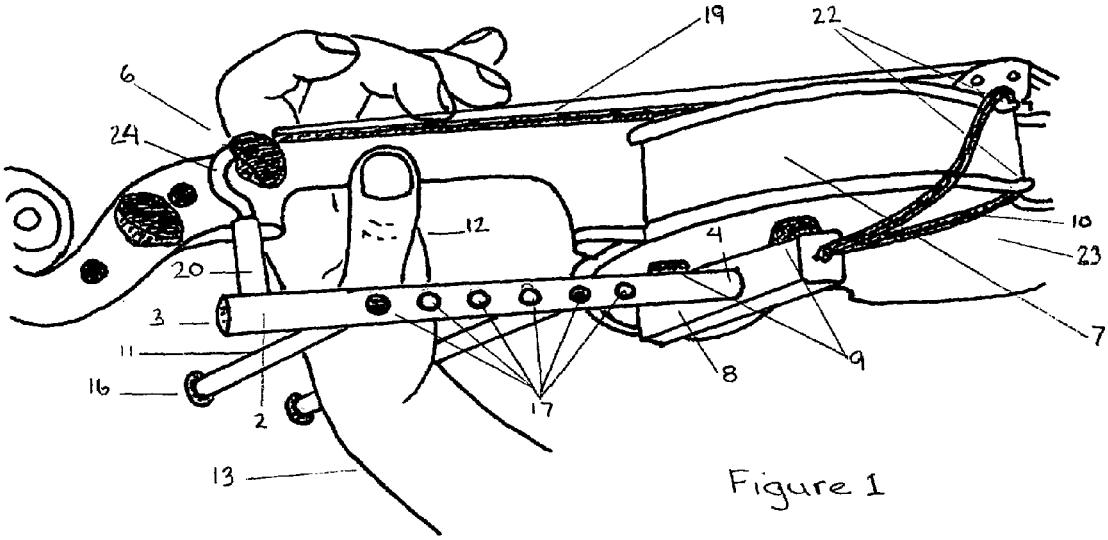
FIG. 1 is perspective view of the Vibrato Trainer affixed to a violin being used by a violinist.
Figure 2:
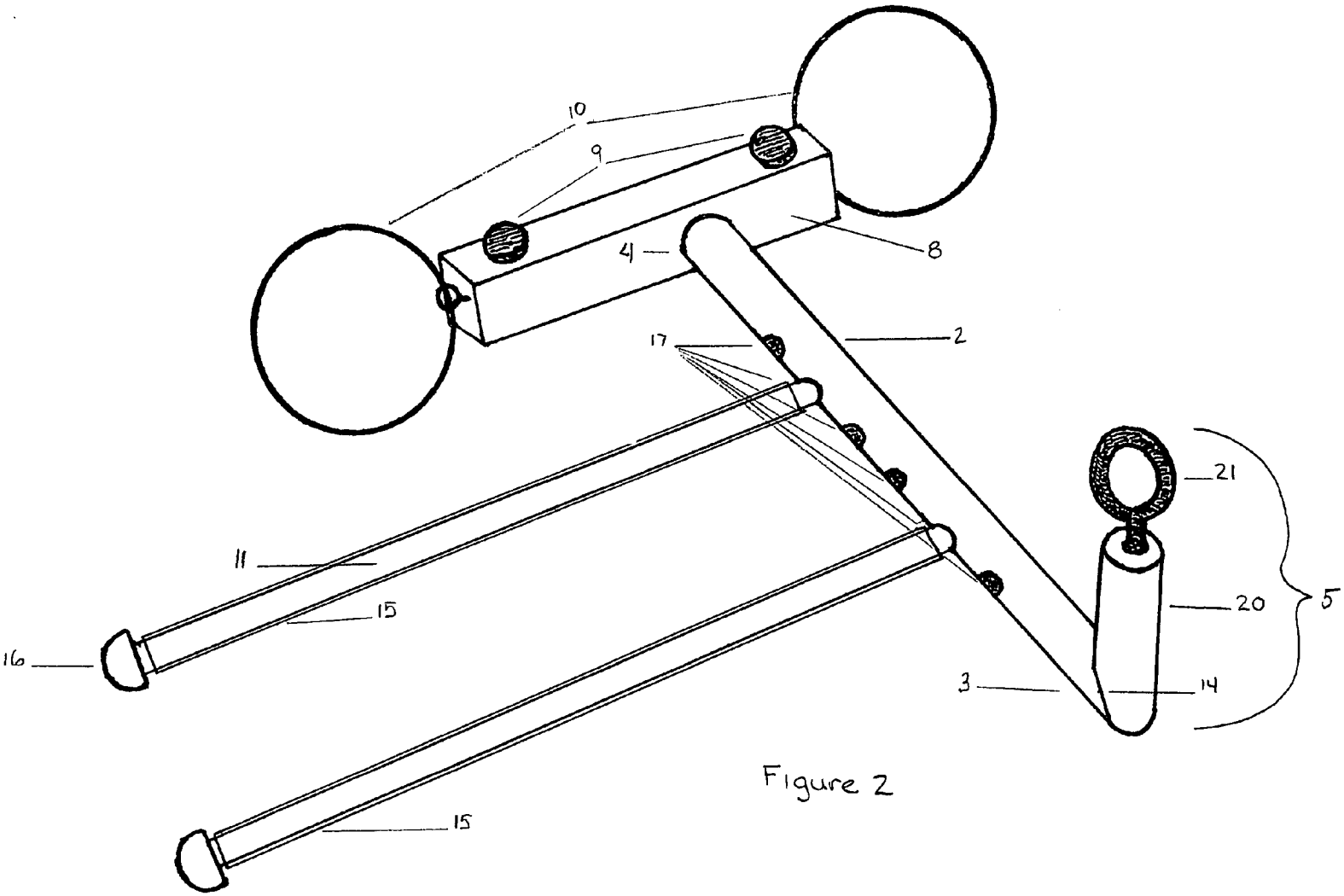
FIG. 2 is a perspective view of one embodiment of the Vibrato Trainer.
Figure 3:
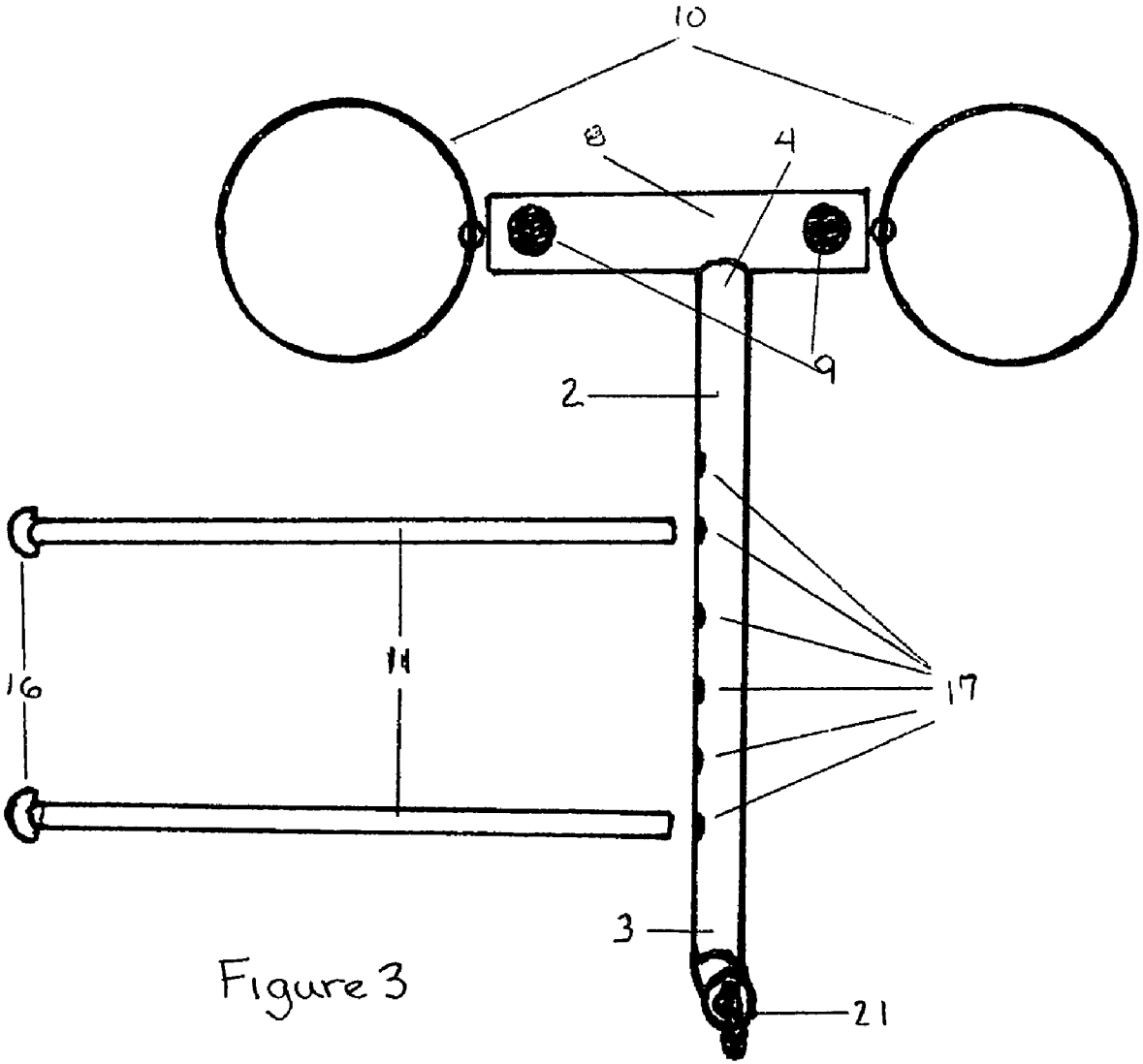
FIG. 3 is a plan view of one embodiment of the Vibrato Trainer.
Figure 4:
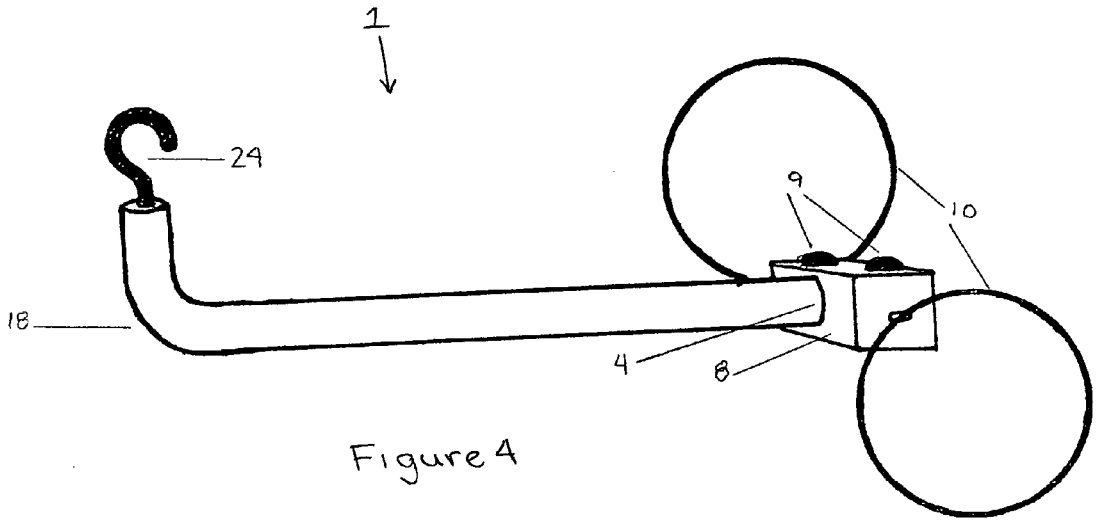
FIG. 4 is a perspective view of an alternative embodiment of the Vibrato Trainer.
Figure 5:
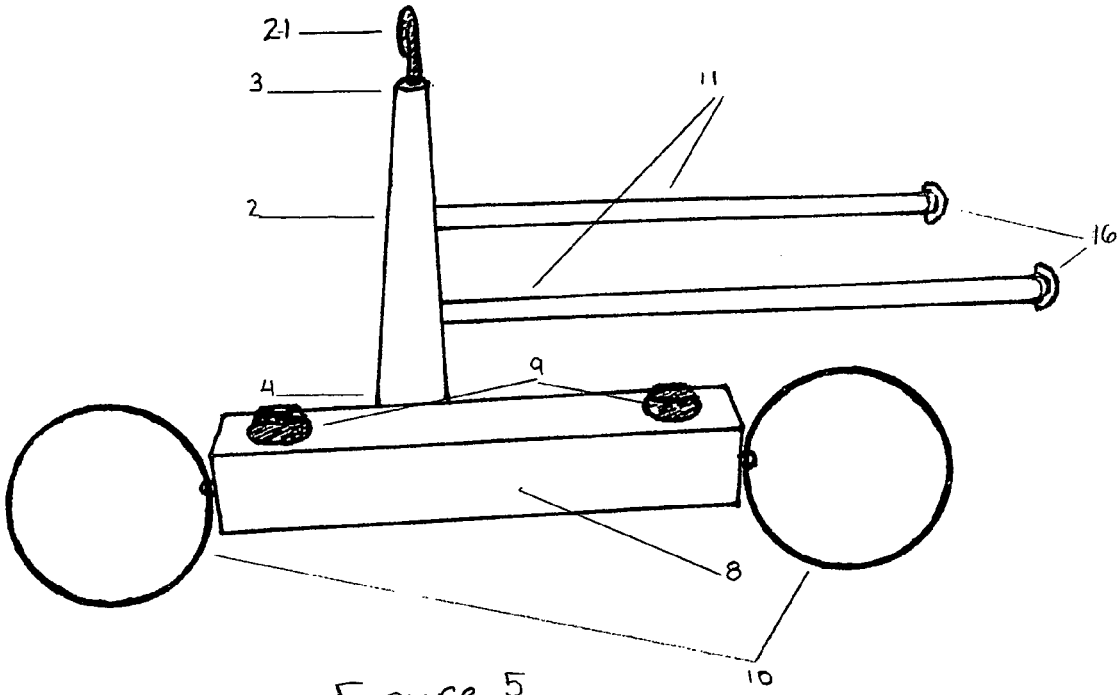
FIG. 5 is a perspective view of an alternative embodiment of the Vibrato Trainer
Figure 6:
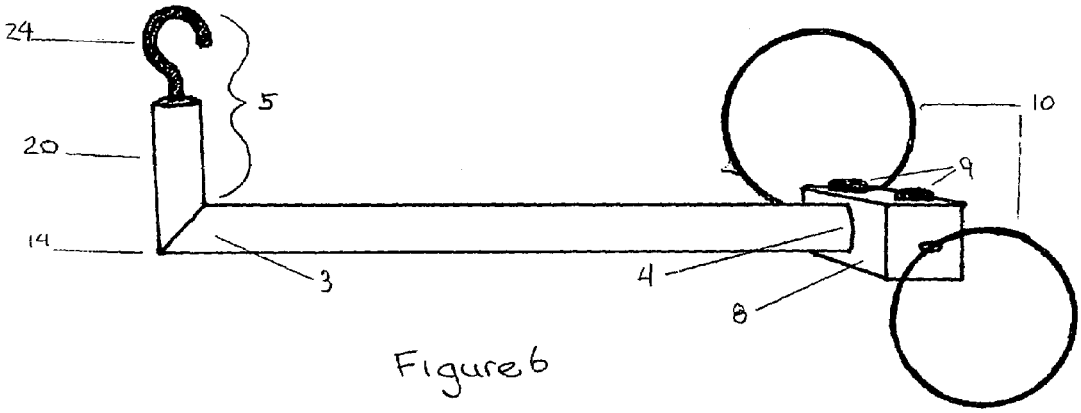
FIG. 6 is a perspective view of an alternative embodiment of the Vibrato Trainer

The Vibrato trainer 1 comprises: a stem 2, said stem 2 having a first end 3 and a second end 4; an attachment assembly 5 for securing said stem 2 to a tuning peg 6 of a musical instrument 7 and attached to said first end 3 of said stem 2; and a base 8 attached to said second end 4 of said stem 2; a plurality of pads 9 attached to said base 8 to assure stable placement of said base 8 against said musical instrument 7; one or more elastic bands 10 attached to said base 8 for securing said base 8 to said musical instrument 7; and one or more guide posts 11 for guiding the hand 12 and wrist 13, said guide posts 11 removably attached to said stem 2.

The stem 2 may be curved or provided with a joint 14 to assure a desired spacing between said stem 2 and said musical instrument 7 at locations where said guide posts 11 are attached to said stem 2.

The guide posts 11 may be covered with sheaths 15. The sheaths 15 may be fixed to the guide posts 11 or the sheaths 15 may rotate around the guide posts 11. The sheaths 15 may be retained upon the guide posts 11 by knobs 16 or other fixtures placed on the ends of the guide posts 11.

The guide posts 11 may be attached to the stem 2 by means of holes 17 provided in the stem 2 which retain the guide posts by employing: 1) friction, 2) an adhesive, 3) fasteners designed specifically to attach the guide posts 11 to the stem 2, or 4) wood screws, nails, dowels or machine screws.

The stem 2 may comprise a single curved part 18 with the curve designed to assure the Vibrato trainer 1 is positioned parallel to the instruments finger board 19. Alternatively this placement may be achieved using a spacer 20 between the attachment means 21 and the stem 2. It will be appreciated that the attachment means 21 may be a hook, elastic band, or any other mechanism suitable for removably attaching the stem 2 to the tuning peg 6.

In use the attachment means 21 is attached to the tuning peg 6 of a stringed instrument 7 and the base 8 is placed against the back of the instrument 7 so that the stem 2 is parallel and beneath the finger board 19 of the instrument 7. As shown in FIG. 1, the guide posts 11 are attached to the stem 2 to provide a gentle reminder to help remind the trainee of the proper placement of the hand 12 and wrist 13 while practicing music on the instrument 7. The Vibrato Trainer 1 is held in position by one or more elastic bands 10 attached to the base 8 and either looped over the wings 22 of the instrument 7 or around the body 23 of the instrument 7. When positioned as described in the foregoing the guideposts 11 contact the wrist 13 to provide a physical reminder that the trainee's wrist 13 is out of position when the Trainee contacts any of the guideposts 11.

I claim:

1. A training aid comprising:

a) a stem, said stem having a first end and a second end;

b) an attachment assembly for securing said stem to a tuning peg of a musical instrument and attached to said first end of said stem; and c) a base attached to said second end of said stem;

d) a plurality of pads attached to said base to assure stable placement of said base against said musical instrument;

e) one or more elastic bands attached to said base for securing said base to said musical instrument; and f) one or more guide posts for guiding the hand of an instrument player, said guide posts removably attached to said stem.

2. The training aid of claim 1 wherein said stem is curved to assure a desired spacing between said stem and said musical instrument at locations where said guide posts are attached to said stem.

3. The training aid of claim 1 further comprising sheaths covering said guide posts.

4. The training aid of claim 2 wherein the sheaths can rotate around said guide posts.

5. The training aid of claim 3 further comprising knobs to assure said sheaths remain in position covering said guide posts.

6. The training aid of claim 1 wherein the attachment assembly comprises a hook.

7. A training aid comprising:

a) a stem, said stem provided with a plurality of holes therein and having a first end and a second end;

b) an attachment means for securing said stem to a tuning peg of a musical instrument and attached to said first end of said stem; and c) a base attached to said second end of said stem;

d) a plurality of pads attached to said base to assure stable placement of said base against said musical instrument;

e) one or more elastic bands attached to said base for securing said base to said musical instrument; and f) one or more guide posts for guiding the hand of an instrument player, each of said guideposts removably attached to said stem by insertion in one of said plurality of holes.

8. The training aid of claim 7 further wherein said stem is curved to assure a desired spacing between said stem and said musical instrument at locations where said guide posts are attached to said stem.

9. The training aid of claim 8 further comprising sheaths covering said guide posts.

10. The training aid of claim 9 wherein the sheaths can rotate around said guide posts.

11. The training aid of claim 10 further comprising knobs to assure said sheaths remain in position covering said guide posts.

12. The training aid of claim 7 wherein said guide posts are removably attached to said stem by being frictionally retained in said holes.

13. The training aid of claim 7 wherein the attachment means comprises a hook.

14. A training aid comprising:

a) a stem, said stem provided with a plurality of holes therein and having a first end and a second end;

b) an attachment means for securing said stem to a tuning peg of a musical instrument and attached to said first end of said stem, said attachment assembly comprising an attachment means and a spacer, said spacer having an attachment end and a stem end, said attachment end attached to said attachment means and said stem end attached to the first end of said stem; and c) a base attached to said second end of said stem;

d) a plurality of pads attached to said base to assure stable placement of said base against said musical instrument;

e) one or more elastic bands attached to said base for securing said base to said musical instrument; and f) one or more guide posts for guiding the hand of an instrument player, each of said guideposts removably attached to said stem by insertion in one of said plurality of holes.

15. The training aid of claim 14 further comprising sheaths covering said guide posts.

16. The training aid of claim 15 wherein the sheaths can rotate around said guide posts.

17. The training aid of claim 16 further comprising knobs to assure said sheaths remain in position covering said guide posts.

18. The training aid of claim 14 wherein said guide posts are removably attached to said stem by being frictionally retained in said holes.

19. The training aid of claim 14 wherein the attachment means comprises a hook.

* * * * *